US005933176A

United States Patent [19]

Wakahara

[11] Patent Number: 5,933,176

[45] Date of Patent: Aug. 3, 1999

[54] IMAGE FORMING APPARATUS WITH REDUCED TONER TRANSFER TIME

[75] Inventor: Shirou Wakahara, Osaka, Japan

[73] Assignee: Sharp Kabushiki Kaisha, Osaka, Japan

[21] Appl. No.: 08/784,785

[22] Filed: Jan. 16, 1997

[30] Foreign Application Priority Data

Jan. 16, 1996 [JP] Japan ..... 8-004541

[51] Int. Cl.[6] ..... G03G 15/00; B41J 2/41

[52] U.S. Cl. ..... 347/112; 347/55

[58] Field of Search ..... 347/55, 112, 141

[56] References Cited

U.S. PATENT DOCUMENTS 5,404,155 4/1995 Kitamura ..... 347/55

FOREIGN PATENT DOCUMENTS 63-136058 6/1988 Japan .
4-153048 5/1992 Japan .
6-218977 8/1994 Japan .

OTHER PUBLICATIONS

Dynamic Simulation of Toner Particle Motion in a TonerJet Printer; Jerome Johnson, 1995.

M. Masataka, "Image Forming Service", Japanese Laid–Open Patent Publication No. 6–155798, Laid Open on Jun. 3, 1994.

*Primary Examiner*—Arthur T. Grimley
*Assistant Examiner*—Quana Grainger
*Attorney, Agent, or Firm*—Dike, Bronstein, Roberts & Cushman, LLP; David G. Conlin; George W. Neuner

[57] ABSTRACT

A voltage from a high voltage power source is applied between a toner support and an opposing electrode to generate an electric field between the two elements which permits the toner carried on the toner support to jump to the opposing electrode side. A control electrode is provided between the developer support and the opposing electrode to control the jumping of the toner. The control electrode is formed with annular electrodes around gates through which the toner passes through. Each annular electrode is supplied with a voltage for causing the toner to jump or for prohibiting the toner from jumping. In applying the voltage for causing the toner to jump to each annular electrode, the control power source starts to apply a voltage for prohibiting the toner from jumping, to annular electrode at a time when the jumping toner travel past the location of the control electrode. In this situation, the traveling toner continues to move toward the recording paper on the opposing electrode. Therefore, the time during which the voltage for causing the toner to jump is applied will not exceed the time required for the toner to reach the recording paper. As a result, it is possible to reduce the time span from a toner jump event to the next, and this feature improves the recording speed.

2 Claims, 7 Drawing Sheets

IMAGE FORMING APPARATUS WITH REDUCED TONER TRANSFER TIME

BACKGROUND OF THE INVENTION (1) Field of the Invention

The present invention relates to an image forming apparatus which directly forms the image on recording medium such as recording paper etc., by causing developer particles to jump thereto and can be applied to a printer unit in digital copiers and facsimile machines as well as to digital printers, plotters, etc.

(2) Description of the Prior Art

In recent years, as the image forming means for outputting a visual image on recording medium such as recording paper etc., in response to an image signal, an image forming apparatus is disclosed in Japanese Patent Application Laid-Open Hei 6 No. 155,798, for example, in which developer particles, i.e., toner, are made to directly adhere to the recording medium to thereby form a toner image on it, directly.

Referring to FIG. 1, the image forming apparatus defined in Japanese Patent Application Laid-Open Hei 6 No. 155, 798 will be described. This apparatus includes an image forming unit 51 having a toner supplying section 52 and a printing section 53. In this apparatus, toner 71 carried in toner supplying section 52 is selectively made to jump to and adhere to a sheet-like recording paper 55 as a recording medium. During this operation, the jumping of toner 71 is controlled in accordance with an image signal so that the toner can selectively adhere to recording paper 55 directly, forming a visual image.

Toner supplying section 52 is composed of a toner reservoir 70 for holding toner 71 as developer particles which are, for example, negatively charged, and a toner support 72 for supporting toner 71 using, for example, magnetic force. Toner support 72 is grounded and rotationally driven in the direction indicated by arrow E in the figure, with its surface speed set at 30 mm/sec, for example. Toner 71 is of a magnetic type having a mean particle diameter of 10 $\mu$m, and is electrified with static charge of −4 $\mu$C/g to −5, $\mu$C/g by a well-known technique. Toner 71 is carried on the peripheral surface of toner support 72 with a mean thickness of about 80 $\mu$m.

Printing section 53 as a part of image forming unit 51 is composed of an opposing electrode 75 made up of an aluminum pipe of, for example, 50 mm in diameter, and a control electrode 76 which is provided between opposing electrode 75 and a toner support 72. Opposing electrode 75 is arranged about 1 mm apart from the peripheral surface of toner support 72, has a high voltage, e.g., 2 kV applied from a d.c. power source 80, and is rotationally driven in the direction of arrow F in the figure, with its surface speed set at 30 mm/sec. Therefore, generated between opposing electrode 75 and toner support 72 is an electric field needed to cause toner 71 supported on toner support 72 to jump toward opposing electrode 75.

Control electrode 76 is disposed in parallel to a tangent plane of the surface of opposing electrode 75 and spreads two-dimensionally facing opposing electrode 75, and it has a structure which permits the toner to pass therethrough from toner support 72 to opposing electrode 75. The electric field formed between toner support 72 and opposing electrode 75 varies depending on the potential being applied to control electrode 76, so that the jumping of toner 71 from toner support 72 to opposing electrode 75 is controlled.

Control electrode 76 is arranged so that its distance from the peripheral surface of toner support 72 is set at 100 $\mu$m, for example. Control electrode 76 is composed of a flexible print board (FPC) 76*a* of 50 $\mu$m thick and annular electrodes 77 are composed of a copper foil of 20 $\mu$m thick. Board 76*a* has gates 79having a diameter of 150 $\mu$m for passage of toner 71. Around these gates 79are arranged the aforementioned annular electrodes 77. Each annular electrode 77 is electrically connected via a feeder line and high-voltage driver (neither is illustrated) to a control power source 81.

Annular electrodes 77 are applied with voltages from control power source 81, corresponding to the image signal. Detailedly, when toner 71 supported on toner support 72 is made to travel toward opposing electrode 75, control power source 81 applies a voltage, e.g., 200 V to annular electrodes 77, so that toner 71 can jump through gates 79 of annular electrodes 77 to the recording paper on the opposing electrode side. In contrast, if the toner need not be passed, the power source 81 applies −200 V to annular electrode 77 to prohibit the toner on toner support 72 from jumping toward opposing electrode 75. In this way, the application of voltages to annular electrodes 77 is performed in accordance with the image signal, so that it is possible to directly form a visual image corresponding to the image signal, on the recording paper 55, by selectively causing the toner to jump.

Here, the rotation of toner support 72, the rotation of opposing electrode 75, the application of voltage to control electrode 76 to prohibit passage of toner 71, and application of the high voltage to the opposing electrode are activated at almost the same time by a common trigger. The transfer time of toner 71 from toner support 72 to recording paper 55 is determined depending upon the amount of static charge on the toner, the distance, and the potential difference applied, between toner support 72 and opposing electrode 75, and in particular, depends on the intensity of the electric field. This time is about 250 $\mu$sec, for example. The voltage application time to annular electrode 77 is set longer than the transfer time, specifically at about 300 $\mu$sec. Thus, the toner is ensured to adhere to recording paper 55 on opposing electrode 75.

In the above image forming apparatus of the prior art, in order to form a single dot on recording paper 55, the time during which the voltage is applied to the control electrode for causing the toner to jump, needed to be longer than the time required for the toner to transfer from the toner support to the opposing electrode, i.e., 250, $\mu$sec. Specifically, the voltage application time needed to be as long as 300 $\mu$sec, for example, to ensure the toner jumped and reached the recording paper. This becomes an obstacle for increasing the recording rate of this technique. In this way, up to now, it is impossible to expect this method to achieve high speed recording because of this time restriction.

At a higher resolution of the image, the printing speed must be even lower. In order to enable fast recording in the prior art system, the transfer time of the toner, that is, the time required for the toner to jump across the distance from the toner support to opposing electrode side, should be shortened. If this can be done, the time taken for application of voltage to the control electrode, can be shortened, so that it naturally becomes possible to perform high speed processing.

Nevertheless, the reduction in transfer time of the toner, involves many problems. Specifically, to shorten the transfer time of the toner, the electric field formed between the toner support and the opposing electrode should be enhanced. In particular, when the toner support side is grounded, the voltage to be applied to the opposing electrode may and should be increased to create a stronger electric field. However, the enhancement of the voltage not only needs an increased number of electric parts but also requires a greater level of insulation against high voltage to deal with the problems such as leakage, etc.

Also considered can be the shortening of the jumping distance, so that the transfer time can be reduced. However, there is a limit to shortening the jumping distance because of the size of the toner, the thickness of the recording paper and the thickness of the control electrode. Thus, as referred to before, it is impossible to reduce the distance between the toner support and the opposing electrode less than about 1 mm.

Another solution considered can be a modification of the property of the toner itself. However, the modification is very difficult under the present technology. Even if it were possible, it is impossible for a printer image of the type represented by the image forming apparatus disclosed in Japanese Patent Application Laid-Open Hei 6 No. 155,798 to shorten the voltage application time to the control electrode for toner jumping, because of the restrictions due to the aforementioned problems.

SUMMARY OF THE INVENTION

In view of the above problems, it is therefore an object of the invention to provide an image forming apparatus which has a simple structure and is still capable of reducing the voltage application time during which a voltage is applied to the control electrode in order for the toner to jump, without reducing the transfer distance of the toner or without shortening the transfer time of the toner.

The present invention has been achieved to attain the above object, and in accordance with the first aspect of the invention, an image forming apparatus includes: a supporting means for supporting developer particles; an opposing electrode disposed facing the supporting means; a control electrode disposed between the supporting means and the opposing electrode and having a plurality of gates which form passage for the developer particles; and a controlling means which generates a predetermined potential difference between the supporting means and the opposing electrode and controls passage of the gates for the developer particles forming the image, and is characterized in that the controlling means is configured so that the time during which the voltage for causing the developer particles to jump to the opposing electrode side is imparted to the control electrode is set shorter than the time required for the developer particles to travel from the supporting means to the opposing electrode.

In accordance with the second aspect of the invention, an image forming apparatus includes: a supporting means for supporting developer particles; an opposing electrode disposed facing the supporting means; a control electrode disposed between the supporting means and the opposing electrode and having a plurality of gates which form passage for the developer particles; and a controlling means which generates a predetermined potential difference between the supporting means and the opposing electrode and controls passage of the gates for the developer particles forming the image, and is characterized in that the controlling means is configured so that the time during which the voltage for causing the developer particles to jump to the opposing electrode side is imparted to the control electrode is set longer than the time required for the developer particles to travel from the supporting means to the control electrode.

In accordance with the third aspect of the invention, an image forming apparatus includes: a supporting means for supporting developer particles; an opposing electrode disposed facing the supporting means; a control electrode disposed between the supporting means and the opposing electrode and having a plurality of gates which form passage for the developer particles; and a controlling means which generates a predetermined potential difference between the supporting means and the opposing electrode and controls passage of the gates for the developer particles forming the image, and is characterized in that the time during which the voltage for causing the developer particles to jump to the opposing electrode side is imparted to the control electrode is set longer than the time required for the developer particles to travel from the supporting means to the control electrode, and shorter than the time required for the developer particles to travel from the supporting means to the opposing electrode.

In the image forming apparatus thus configured, an example of the developer particles is toner, and the developer support is a structure which carries the toner. The toner will or will not jump toward the opposing electrode, selectively in accordance with the potential applied to the control electrode. When the voltage for causing the toner to jump is applied to the control electrode, the toner starts to jump toward the opposing electrode. At this moment, the toner traveling past the control electrode can continue to travel toward the opposing electrode, totally regardless of the potential applied to the aforementioned control electrode. In other words, if the electric field between the control electrode and the opposing electrode varies more or less due to the change of the voltage applied to the control electrode, the direction of the force of the electric field acting on the toner is unchanged, that is, is constantly oriented toward the opposing electrode. Accordingly, once the voltage for causing the toner to jump was applied to the control electrode, and then if the toner only has traveled past the control electrode, the toner will definitely continue to travel toward the opposing electrode until arrival at opposing electrode side, even without any toner jump voltage applied to the control electrode.

As a result, before the arrival of the toner at the opposing electrode, the toner jump voltage being applied to the control electrode is changed into the voltage which does not allow the toner to jump, the toner once having jumped can definitely reach the opposing electrode side. Further, if the potential of the control electrode is changed into the voltage which does not allow the toner to jump after the jumping toner has traveled past the control electrode, the traveling toner will similarly reach the opposing electrode side. Moreover, in the case where the voltage for causing the toner to jump is applied to the control electrode, if the potential of the control electrode is changed into the voltage which does not allow the toner to jump after it has traveled past the control electrode and before it reaches the opposing electrode side, it is possible to definitely make the jumping toner reach the opposing electrode side.

Thus, the time during which the toner jump voltage is applied to the control electric is reduced. This means reduction of the time span from a toner jump event to the next, and this feature enables high-speed recording and recording at a higher resolution.

DESCRIPTION OF THE PREFERRED EMBODIMENTS

Embodiments of the invention will be described in detail with reference to FIGS. 2 through 8.

Figure 1:
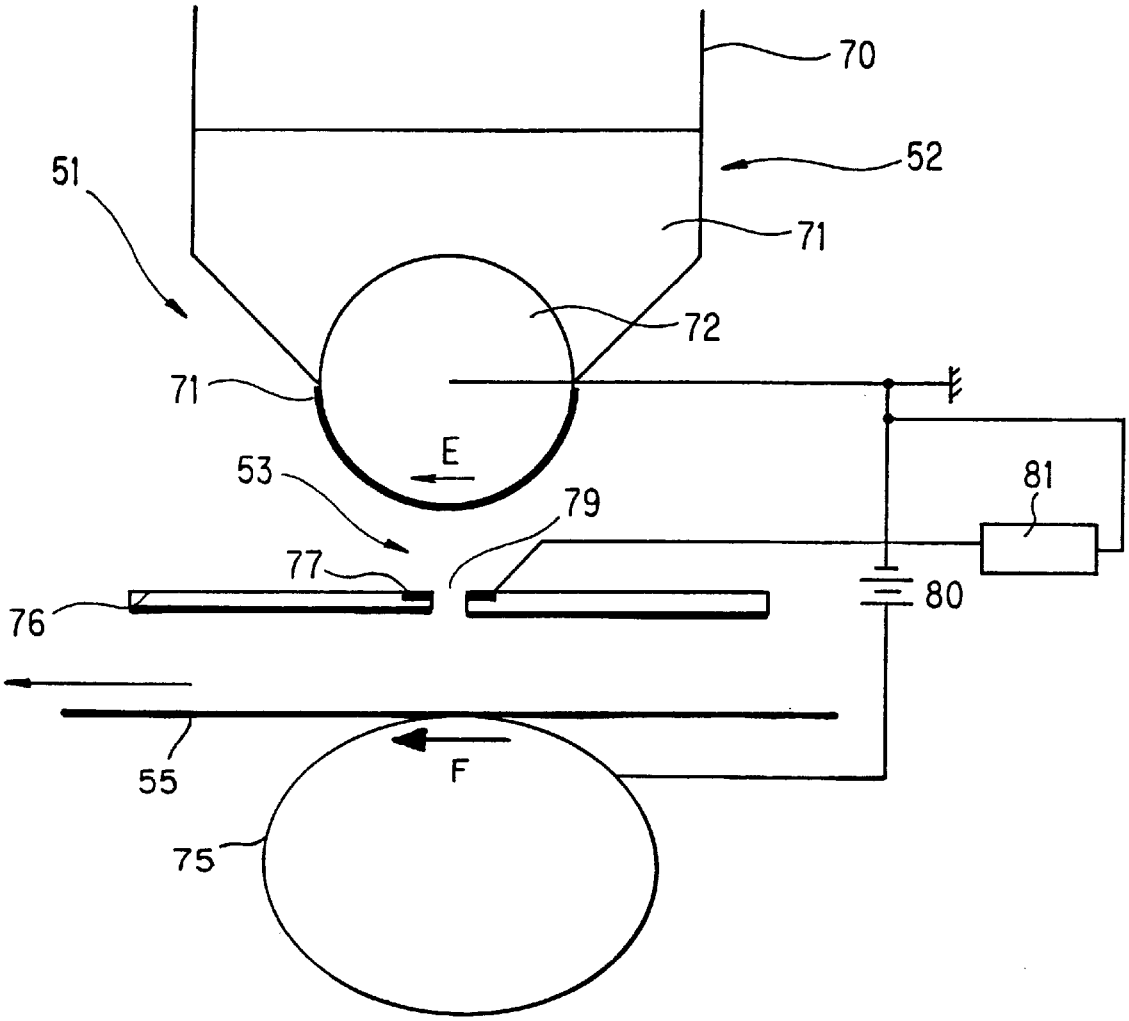
FIG. 1 PRIOR ART
FIG. 1 is a sectional view for illustrating the principle of image forming of a conventional image forming apparatus.
Figure 2:
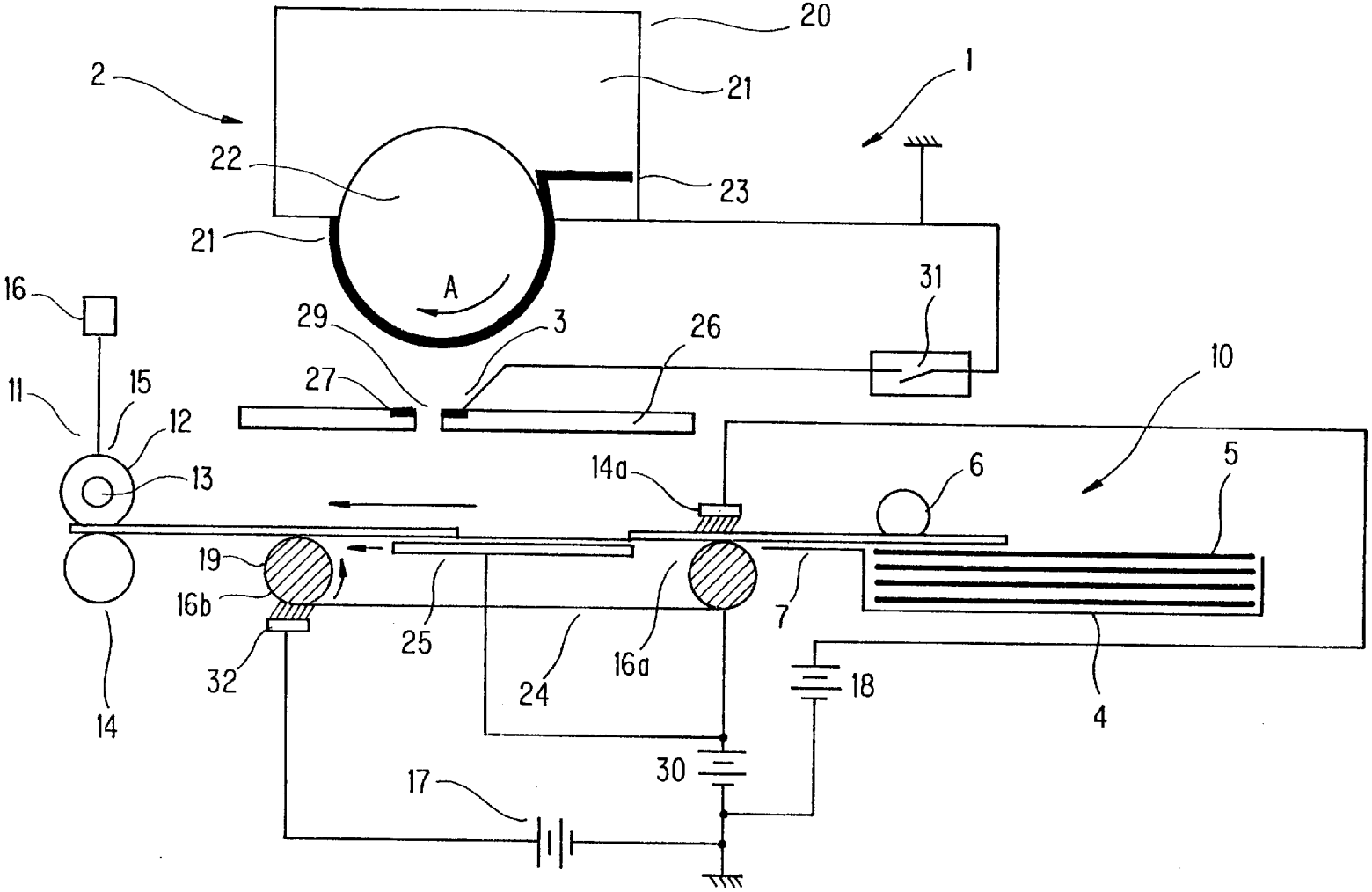
FIG. 2 is a schematic sectional view showing the overall configuration of an image forming apparatus of the invention.

FIG. 2 is a schematic sectional view showing the overall configuration of an image forming apparatus of the invention. In FIG. 2, the image forming apparatus of the invention has an image forming unit 1 which is composed of a toner supplying section 2 and a printing section 3. Image forming unit 1 creates a visual image in accordance with an image signal, onto recording paper as recording medium with toner as developer particles. In this image forming apparatus, the toner is selectively made to jump and adhere onto recording paper 5, and the jumping of the toner is controlled based on the image forming signal, so as to directly create the image on recording paper 5.

A paper feeder 10 is provided on the side of image forming apparatus 1 to which recording paper 5 is fed. Paper feeder 10 is composed of a paper cassette 4 for storing recording paper 5 as recording medium, a pickup roller (feed roller) 6 for delivering recording paper 5 sheet by sheet from paper cassette 4, and a paper guide 7 for guiding recording paper 5 sent out. Paper feeder 10 further has unillustrated detecting sensors for detecting the feed of recording paper 5, at positions in the path of paper feeding. Pickup roller 6 is rotationally driven by means of an unillustrated driver.

Provided on the output side of image forming apparatus 1 from which recording paper 5 is outputted, is a fixing unit 11 for heating and pressurizing the toner image which was formed on recording paper 5 at the image forming unit 1, to fix it onto recording paper 5. Fixing unit 11 is composed of a heat roller 12, a heater 13, a pressure roller 14, a temperature sensor 15, and a temperature controller circuit 16. Heat roller 12 is made up of, for example, an aluminum pipe of 2 mm thick with a coating such as fluororesin, etc., which has a good separation performance with respect to the toner. Heater 13 is a halogen lamp, for example, which is incorporated in heat roller 12. Pressure roller 14 is a pipe made up of, for example, aluminum etc., with its surface coated with silicone resin. Heat roller 12 and pressure roller 14 which are arranged opposite each other, are pressed against one another in order to hold recording paper 5 in between and pressurize it, with a pressurizing load, e.g. 2 kg, from unillustrated springs etc., provided at both ends of their shafts.

Temperature sensor 15 measures the surface temperature of the heat roller 12. Temperature controller circuit 16 is controlled by a main controller, which will be described later, and performs the on/off operation of heater 13 or other control based on the measurement of temperature sensor 15, thus maintaining the surface temperature of heater roller 12 at, for example, 150° C.

Fixing unit 11 has an unillustrated paper discharge sensor for detecting the discharge of recording paper 5 processed through fixing unit 11. The materials of heat roller 12, heater 13, pressure roller 14, etc., are not specifically limited. The surface temperature of heat roller 12 also is not specifically limited. Further, fixing unit 11 may use a fixing process in which the toner image is pressed and fixed onto recording paper, besides the heating and fixing process.

Further, although it is not shown in the drawing, the paper output side of fixing unit 11 has a paper discharge roller for discharging recording paper 5 processed through fixing unit 11 onto a paper output tray and a paper output tray for holding recording paper 5 thus discharged. The aforementioned heat roller 12, pressure roller 14 and paper discharge roller are rotated by an unillustrated driving means so as to discharge recording paper 5.

Toner supplying section 2 as part of image forming apparatus 1 is composed of a toner storage tank 20 for storing toner 21 as developer particles, a toner support 22 of a cylindrical sleeve for magnetically supporting toner 21, a doctor blade 23 which is provided inside toner storage tank 20 to electrify toner 21 and regulate the thickness of the toner layer carried on the peripheral surface of toner support 22.

Doctor blade 23 is arranged on the upstream side of toner support 22 with respect to the rotational direction, spaced with a distance of about 60 $\mu$m, for example, from the peripheral surface of toner support 22. Toner 21 is of a magnetic type having a mean particle diameter of, for example, 6 $\mu$m, and is electrified with static charge of −4 $\mu$C/g to −5 $\mu$C/g by doctor blade 23. Here, the distance between doctor blade 23 and toner support 22 is not particularly limited, and is specified appropriately in association with the amount of toner to be conveyed. The mean particle size, the amount of static charge, etc., of toner 21 are not particularly limited, but can be specified as necessary. Toner support 22 is rotationally driven by an unillustrated driving means in the direction indicated by arrow A in the figure, with its surface speed set at about 100 mm/sec, for example.

Toner support 22 is grounded and has unillustrated fixed magnets therein, at the position opposite doctor blade 23 and at the position opposite a control electrode (which will be described later). This arrangement permits toner support 22 to carry toner 21 on its peripheral surface, and as the sleeve of toner support 22 rotates, toner being magnetically attracted to (supported by) the sleeve can be conveyed. Toner 21 supported on the peripheral surface of toner support 22 is made to stand up in 'spikes' at the areas on the peripheral surface corresponding the above positions of the magnets. Rotating speed of toner support 22 is not limited particularly, and may be determined based on the amount of the toner to be conveyed, etc. Here, the toner is supported by magnetic force, but toner support 22 can be configured so as to support toner 21 by electric force or combination of electric and magnetic forces.

Printing section 3 in image forming apparatus 1 includes: an opposing electrode 25 which is made up of an aluminum sheet of, for example, 1 mm in thick and faces the peripheral surface of toner support 22; a high-voltage power source 30 for supplying a high voltage to opposing electrode 25; a control electrode 26 provided between opposing electrode 25 and toner support 22; a charge eraser brush 32; a charge eraser power source 17 for applying a charge eraser voltage to charge eraser brush 32; a charger brush 14*a* for charging recording sheet 5; a charger power source 18 for supplying a charger voltage to charger brush 14*a*; a dielectric belt 24; a pair of support rollers 16*a* and 16*b* for supporting and driving dielectric belt 24; and a cleaner blade 19.

Dielectric belt 24 which is driven in contact with opposing electrode 25 and conveys recording paper 5, is of an endless type of about 75 $\mu$m thick, made of polyvinylindene fluoride (PVDF) as a base material, with a volume resistivity of about $10^{14}$ Ω cm. Dielectric belt 24 is tensioned between support roller 16*a* and 16*b*, and is rotated by an unillustrated driving means through a support roller, e.g., 16*b*, in the direction of the arrow in the drawing, at a surface speed of, for example, 30 mm/sec.

Applied to opposing electrode 25 is a high voltage, e.g., 2.3 kV from high voltage power source (controlling means) 30. This high voltage supplied from high voltage power source 30 generates an electric field between opposing electrode 25 and toner support 22, required for causing toner 21 being supported on toner support 22 to jump toward opposing electrode 25.

Charge eraser brush 32 is pressed against dielectric belt 24 at a position downstream, relative to the rotational direction of dielectric belt 24, and of the area facing control electrode 26. Charge eraser brush 32 has an eraser potential of 2.5 kV applied from charge eraser power source 17 so as to eliminate unnecessary charges on the surface of dielectric belt 24.

If some toner 21 adhered to the surface of dielectric belt 24 due to a contingency such as paper jam, etc., cleaning blade 19 removes this toner 21 to prevent staining by toner 21 on the paper underside. The material of opposing electrode 25 is not particularly limited, and it can be formed of an appropriate material meeting the requirements. The distance between opposing electrode 25 and toner support 22 is not particularly specified either, and can be set appropriately. Further, the rotational speed of opposing electrode 25 or the voltage to be applied thereto is not limited either, and can be set appropriately in conformity with the toner and speed used.

Although unillustrated, the image forming apparatus includes: a main controller as a control circuit for controlling the whole image forming apparatus; an image processor for converting the image data obtained from image pickup device for reading an original image etc., into a format of image data to be printed; an image memory for storage of the image data; and an image forming control unit for converting the image data obtained from the image processor into the image data to be given to control electrode 26.

For effecting the above operation, control electrode 26 is disposed in parallel to the tangent plane of the surface of opposing electrode 25 and spreads two-dimensionally facing opposing electrode 25, and it has a structure to permit the toner to pass therethrough from toner support 22 to opposing electrode 25. The electrode field formed between toner support 22 and opposing electrode 25 varies depending on the potential being applied to control electrode 26, so that the jumping of toner 21 from toner support 22 to opposing electrode 25 is selectively controlled.

Control electrode 26 is arranged so that its distance from the peripheral surface of toner support 22 is set at 100 $\mu$m, for example, and is secured by means of an unillustrated supporter member. As shown in detail in FIG. 3, control electrode 26 is composed of an insulative board 26*a*, a high voltage driver (not shown), annular conductors independent of one another, i.e., annular electrodes 27. Board 26*a* is made from a polyimide resin, for example, with a thickness of 25 $\mu$m. The board further has holes forming gates 29to be mentioned later, formed therein. Annular electrodes 27 are formed of copper foil, for instance, and are arranged around individual holes 29 in a predetermined manner on the surface which faces toner support 22 of board 26*a*. Each annular electrode 27 is formed 220 $\mu$m in diameter and 30 $\mu$m thick, for example. Each opening 29 of annular electrode 27 is set at 200 $\mu$m in diameter, for example, forming a passage for toner 21 to jump from toner support 22 to opposing electrode 25. This passage will be termed gate 29. Here, the distance between control electrode 26 and toner support 22 is not specifically limited.

The size of gates 29and the materials and thickness of board 26*a* and annular electrodes are not particularly limited. In the above case, gates 29or annular electrodes 27 are formed at 2,560 sites. Each annular electrode 27 is electrically connected to a control power source 31 (to be described later) via individual feeder lines 28 and a high voltage driver (not shown). The number of electrodes corresponds to a resolution of 300 DPI (dot per inch) across the width of A4 sized paper, forming one line of the image.

Here, the number of annular electrodes 27 is not particularly limited. The surface of annular electrodes 27 as well as the surface of feeder lines 28 is coated with an insulative layer (not shown) as thick as 30 $\mu$m, thus ensuring insulation between annular electrodes 27, insulation between feeder lines 28, and insulation between annular electrodes 27 and feeder lines 28. The material, thickness etc., of this insulative layer are not particularly limited.

Supplied to annular electrodes 27 of control electrode 26 are voltages or pulses in accordance with the image signal from control power source (controlling means) 31. Specifically, when toner 21 carried on toner support 22 is made to pass toward opposing electrode 25, a voltage, e.g., 150 V is applied to annular electrodes 27. When the toner is blocked to pass, a voltage, e.g., −200 V is applied. In this way, whilst the voltage (potential) to be imparted to control electrode 26 is controlled in accordance with the image signal, a recording paper 5 is fed along opposing electrode 25 on the side thereof facing toner support 22. Thus, a toner image is formed on the surface of recording paper 5 in accordance with the image signal. Here, control power source is controlled by a control electrode controlling signal transmitted from an unillustrated image forming control unit.

Figure 4:
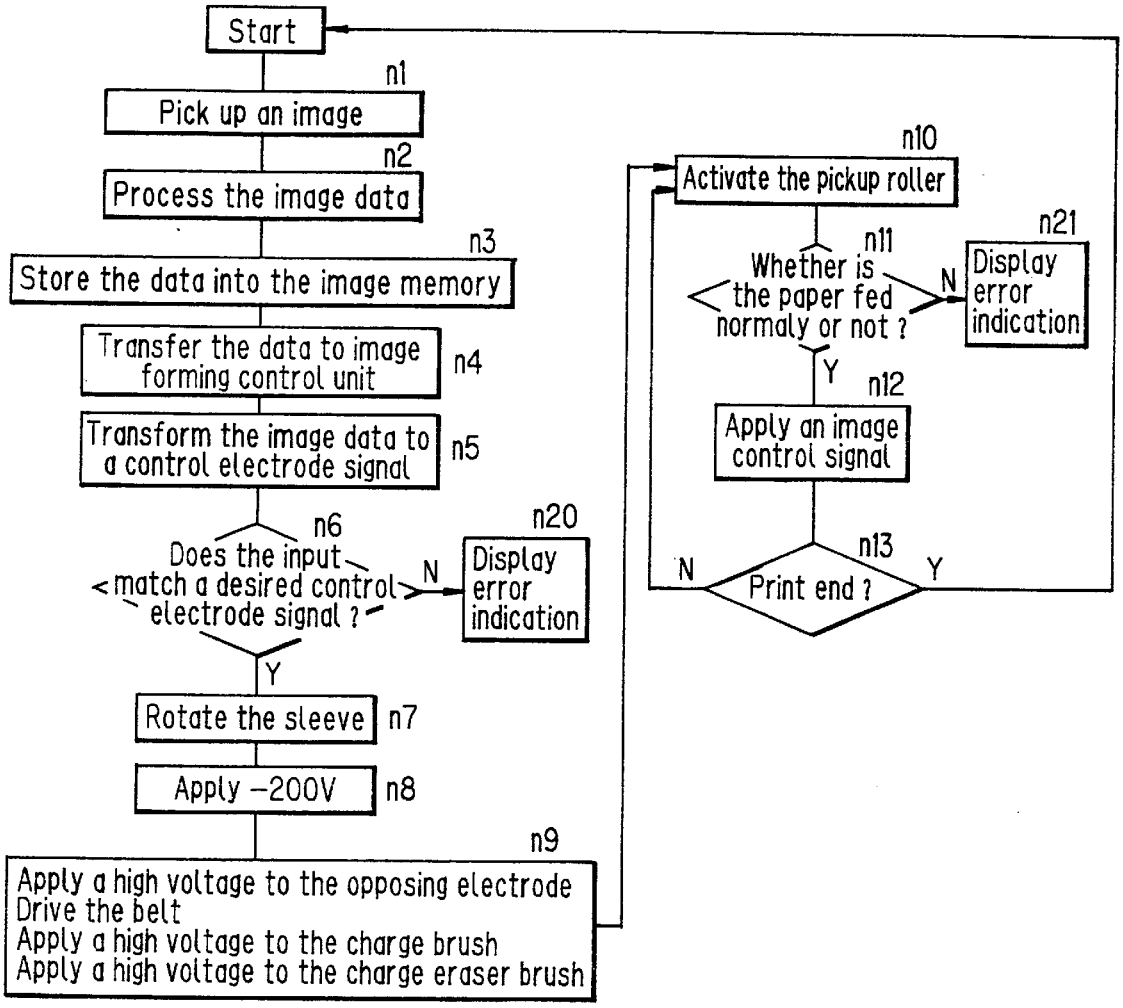
FIG. 4 is a flowchart showing the flow of a recording control operation.

Next, the image forming operation performed by the image forming apparatus will be described with reference to FIG. 4.

First, when the copy start key (not shown) is operated with an original to be copied set on the image pickup section, the main controller receives this input and starts the image forming operation. Illustratively, the image pickup section reads the original image (Step n1), and the image data is processed in the image processing section (Step n2) to be stored into the image memory (Step n3). As the image data stored in this image memory is transferred to the image forming control unit (Step n4), it starts to transform the input image data into a control electrode controlling signal to be imparted to control electrode 26 (Step n5). When the image forming control unit acquires a predetermined amount of the control signal to be supplied to the control electrode, toner support 22 starts to rotate (Step n7), while a voltage equal to opposing electrode 25 is applied from high voltage power source 30 (Step n9). Charger brush 14*a* is applied with a charging potential of 1.2 kV from charger power source 18 while charge eraser brush 32 is applied with an erasing potential from charge eraser power source 17 (Step n9).

Here, when the input does not match a desired control electrode signal, this flow is interrupted at Step n6, and an error indication is displayed (Step n20). When the input is confirmed to be the desired one, and the image forming control unit has acquired, as stated above, a predetermined amount of the control signal to be supplied to the control electrode, predetermined high voltages are applied to opposing electrode 25, charger brush 14*a* and charge eraser brush 32 while −200 V, a potential for prohibiting the toner from jumping is applied to all the annular electrodes 27 of control electrode 26.

Thereafter, an unillustrated driver is activated to rotate pickup roller 6, which delivers a sheet of recording paper 5 out from paper cassette 4 toward image forming unit 1 (Step n10). At that moment, at Step n11, it is judged whether the paper is fed normally or not. Specifically, when recording paper 5 fed is detected by the sensor in the conveying path, the operation is judged as normal, followed by Step n12.

Here, recording paper 5 delivered out by pickup roller 6 is conveyed between charger brush 14*a* and support roller 16*a*. Recording paper 5 is supplied with charges due to the potential difference between charger brush 14*a* and support roller 16*a*. Electrostatically attracted to dielectric belt 24, recording paper 5 is conveyed with the advance of the belt, to a position in printing section 3 of image forming unit 1, where dielectric belt 24 faces toner support 22. The aforementioned predetermined amount of the control electrode controlling signal varies depending on the image forming apparatus used and other factors.

At Step n12, the image forming control unit supplies the control electrode controlling signal to control power source 31. This control electrode controlling signal is supplied at a time synchronized with the supply of recording paper 5 from charger brush 14*a* to printing section 3. Control power source 31 controls the voltages to be applied to annular electrodes 27 of control electrode 26 based on the control electrode controlling signal. Illustratively, the voltage, 150 V or −200 V is appropriately applied to each or predetermined annular electrodes 27 from control power source 31 so as control the electric field around control electrode 26. Accordingly, at each gate 29 of control electrode 26, the jumping of toner 21 from toner support 22 toward opposing electrode 25 is prevented or permitted appropriately in accordance with the image data. Thus, a toner image in conformity with the image signal is formed on recording paper 5 which is moving at the rate of 30 mm/sec toward the paper output side by the advance of dielectric belt 24. The control by control power source 31 of the invention will be described in detail hereinbelow.

Recording paper 5 with the toner image formed thereon is separated from dielectric belt 24 by the curvature of support roller 16*b* and is conveyed to fixing unit 11, where the toner image is fixed to recording paper 5. Recording paper 5 with the toner image fixed thereon is discharged by the discharge roller onto paper output tray. At the same time, the fact that the paper is normally discharged is detected by the paper discharge sensor.

The main controller judges the printing operation to be normally performed, from the above detection. By the image forming operation described above, a good image is created on recording paper 5. Since this image forming apparatus directly forms the image on recording paper 5, it is no longer necessary to use a developer medium such as photoreceptor, dielectric drum, etc., which were used in conventional image forming apparatuses.

As a result, the transfer operation for transferring the image from the developer medium to the recording paper can be omitted, thus eliminating the degradation of the image and improving the reliability of the apparatus. Since the configuration of the apparatus can be simplified needing fewer parts, it is possible to reduce the apparatus in size and cost.

Now, consider that the jumping of toner 21 from toner support 22 to opposing electrode 25 caused by the voltage application therebetween. As stated already, toner support 22 is grounded while a high voltage, i.e., 2.3 kV is applied to opposing electrode 25. In this condition, recording paper 5 will have a surface potential of 2 kV due to the equilibrium of the surface charges of recording paper 5.

As a result, equipotential surfaces from 0 V to 2 KV are formed at regular intervals between toner support 22 and recording paper 5. Opposing electrode 25 is arranged 1 mm apart from peripheral surface of toner support 22, and control electrode 26 is set up 100 $\mu$m apart from the peripheral surface of toner support 22. Therefore, the potential at the center of each gate 29 (each gate center) of control electrode 26 is set at about 200 V. Here, the potential at the center of each gate 29 will be determined by the potential difference between toner support 22 and opposing electrode 25, the geometry of control electrode 26, the shape of gates 29, etc.

Figure 5:
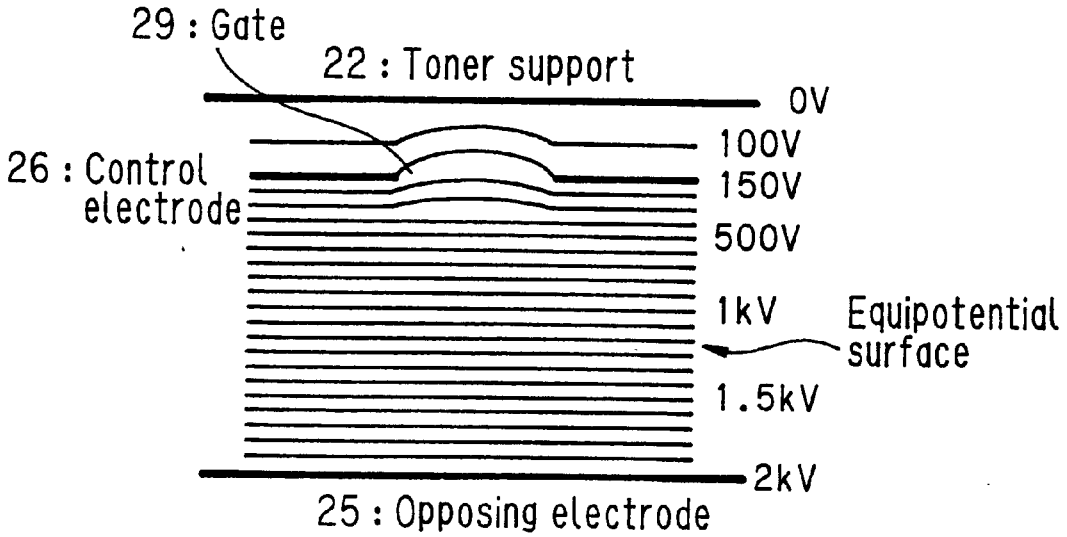
FIG. 5 is an illustrative view for illustrating the principle of the toner jumping, showing equipotential surfaces when the toner is caused to jump.

In this condition, in order for toner 21 carried on toner support 22 to pass toward opposing electrode 25, control power surface 31 is caused to apply a voltage of 150 V to annular electrodes 27 of control electrode 26, for 150 $\mu$sec per pixel. When this voltage is applied, the equipotential surfaces near gate 29 of control electrode 26 change as shown in FIG. 5. More explicitly, the equipotential surfaces in the spatial region around gate 29 become curved toward toner support 22.

Figure 6:
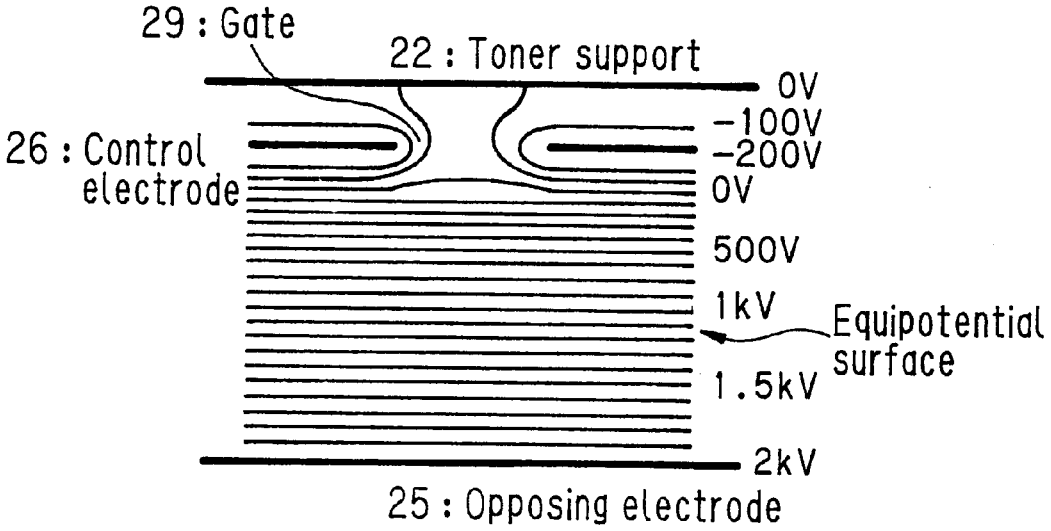
FIG. 6 is an illustrative view for illustrating the principle of the toner jumping, showing equipotential surfaces when the toner is stopped to jump.

Similarly, when a voltage of −200 which will not permit toner 21 to pass through gate 29 is applied to annular electrode 27, the equipotential surface as shown in FIG. 6 is formed. Here, the equipotential surfaces shown in FIGS. 5 and 6 are those determined using computer simulation by the inventor of this application. In this way, the direction of the electric field between control electrode 26 and toner support 22 becomes inverted depending upon the voltage applied to control electrode 26. In FIG. 5, the electric field resides in a state which permits toner 21 carried on toner support 22 to jump toward opposing electrode 25. In FIG. 6, the electric field at gate 29 of control electrode 26 resides a state which blocks the toner transfer or prohibits toner 21 from jumping.

The electric field between control electrode 26 and opposing electrode 25, however, only varies in its intensity; the direction of the field remains perpendicular to the surface of recording paper 5. Accordingly, the state of jumping toner 21 which is past control electrode 26 will hardly be affected by the potential state of control electrode 26.

In the above description, the voltage applied to annular electrodes 27 of control electrode 26 for allowing passage of toner 21 was set at 150 V as an example. This voltage, however, is not limited as long as the jumping control of toner 21 can be performed as desired. It is possible to change the extent to which the equipotential surfaces swell or curve toward toner support 22 in the vicinity of gates 29 of control electrode 26, by changing the potential applied to annular electrodes 27 of control electrode 26. Therefore, it is possible to vary the electric force acting on toner 21 passing through gates 29. This means that appropriate variations in the potential imparted from control power source 31 enables the dot size (FL) of the image formed on recording paper 5 to be adjusted arbitrarily.

The voltage to be imparted to annular electrodes 27 of control electrode 26 to prevent passage of toner 21 should not be particularly limited. The above potential may be determined in practice by carrying out experiments etc.

Here, it is assumed that the image forming apparatus is able to handle six sheets of A4 sized, longitudinally set (lengthwise) recording paper 5 per min (at a rate of 6 sheets/min). In this case, the speed of recording paper 5 over opposing electrode 25 is about 30 mm/sec. Suppose that the resolution is 300 DPI, the processing time spent for each dot in the image formed on recording paper 5, or the pulse width T (sec) applied to annular electrodes 27 . . . . from control power source 31 in accordance with the image signal is shorter than about $2.8\times10^{-3}$ sec.

From the computation under the aforementioned various conditions and from the measurement using a high-speed camera, the time t for toner 21 to jump from toner support 22 to recording paper 5 being delivered along opposing electrode 25, is known to be about 220 μsec, and the time t0 for the toner to jump from toner support 22 to control electrode 26 is about 140 μsec. In the prior art, the pulse width T of the voltage applied to annular electrode 27 to cause toner 21 to jump, was set greater than transfer time t (i.e., t<T). For this reason, it was impossible to increase the recording speed because of the constraint of the time of the pulse width T.

In this invention, since in the area downstream, relative to the toner transfer, of control electrode 26, the directions of the electric field between control electrode 26 and opposing electrode 25 are the same regardless of the voltage being applied to annular electrode 27 of the control electrode as shown in FIGS. 5 and 6, toner 21, if it has already passed through control electrode 26, can continue to travel toward opposing electrode 25 to reach recording paper 5. Therefore, even if the voltage (150 V) applied to allow toner 21 to pass through gate 29 is changed to the voltage (−200 V) which prohibits toner 21 from passing through gate 29, the toner which is traveling continues to travel to reach recording paper 5 forming the image.

Figures 7A, 7B:
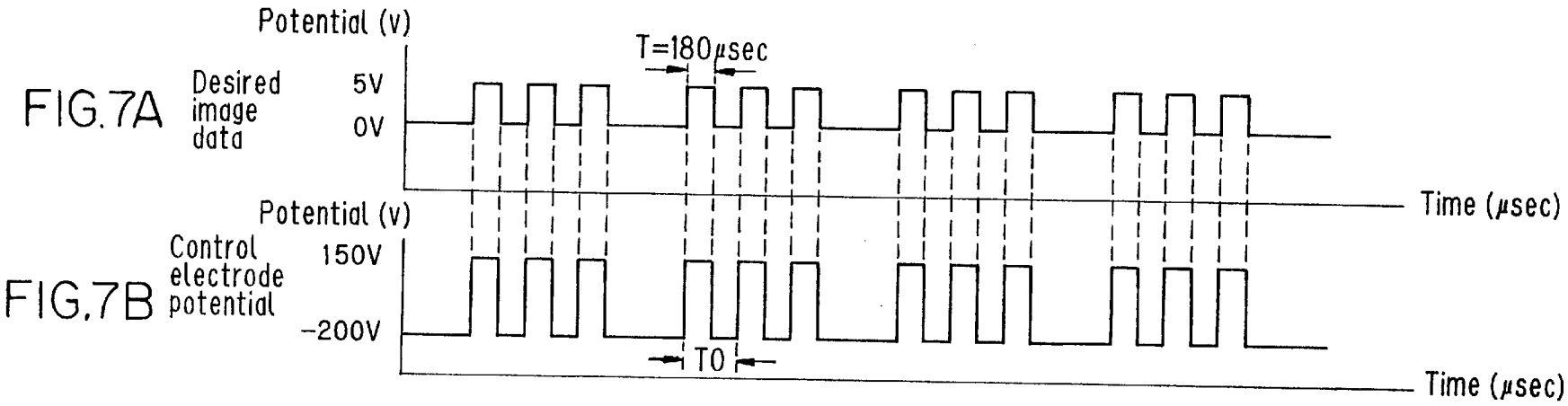
FIG. 7 is a timing chart showing the timing when a signal is applied to the control electrode of the invention.

In this embodiment, if the pulse width T of the voltage applied to annular electrode 27 of control electrode 26 for causing the toner to jump is set at 180 μsec, the jumping toner is able to reach recording paper 5 adequately. Suppose that T designates the time required for toner 21 carried on the surface of toner support 22 at the position corresponding to gate 29 to transfer, or the time (pulse width) during which the voltage imparted to control electrode 26 for causing the toner to pass through gate 29 is applied, the voltage to be applied to control electrode 26 is formed from desired image data, as shown in FIG. 7. In FIG. 7, the following relation holds between the transfer time t and the pulse width T:t=220 μsec>T=180 μsec>t0=140 μsec. Specifically, the voltage (150 V) for causing the toner to jump has been applied to annular electrode 27 of control electrode 26 for 180 μsec, then −200 V as the non-jump voltage is applied to the annular electrode.

When −200 V is applied, toner 21 which is traveling continues to travel to recording paper 5, but the toner on toner support 22 is prohibited from jumping. As a result, it is possible to shorten the time for the toner to start jumping for creating the next line. That is, since the period of time T0 for making the potential level rise to the jump voltage (150 V) can be shortened as compared to that of the prior art, it is possible to increase the recording rate in proportion to the reduction of the period T0 even if the transfer time of the toner is the same as in the prior art.

In general, in order to increase the process speed in an image forming apparatus of the type described above, it is necessary to shorten the transfer time of toner 21 to reach recording paper 5 located at opposing electrode 25, by increasing the transfer speed of the toner. For this purpose, attempts were made to increase the amount of static charge on the toner, or to enhance the applied electric field. However, in the process using the toner, control of the amount of static charge is very difficult and needs modification of the property of the toner. Enhancement of the applied electric field needs a high voltage, thus raising the cost of the power source for the high voltage and requiring other modifications such as enhanced insulation.

With regards to these points, the method of the invention described above does not need any change of the transfer speed of the toner at all. It is not necessary to control toner property in the process using the toner, which are the most difficult to control, such as the amount of static charge. That is, without shortening the transfer speed of toner 21, it is possible to readily improve the process speed and increase the resolution as necessary. Since the transfer speed of the toner need not be changed, it is not necessary to supply a higher voltage to opposing electrode 25 in order to reduce the transfer time of the toner. Accordingly, there is no increment in cost for a high voltage power source nor a need for insulation which would be required for the use of the high voltage.

In this embodiment, since the potential of control electrode 26 is changed after the required toner 21 is made to pass through gates 29, the toner 21 to be transferred definitely reaches recording paper 5, thus making it possible to produce an image with no reduction in density or degradation of the image without causing any transfer defects of toner 21.

Figure 3:
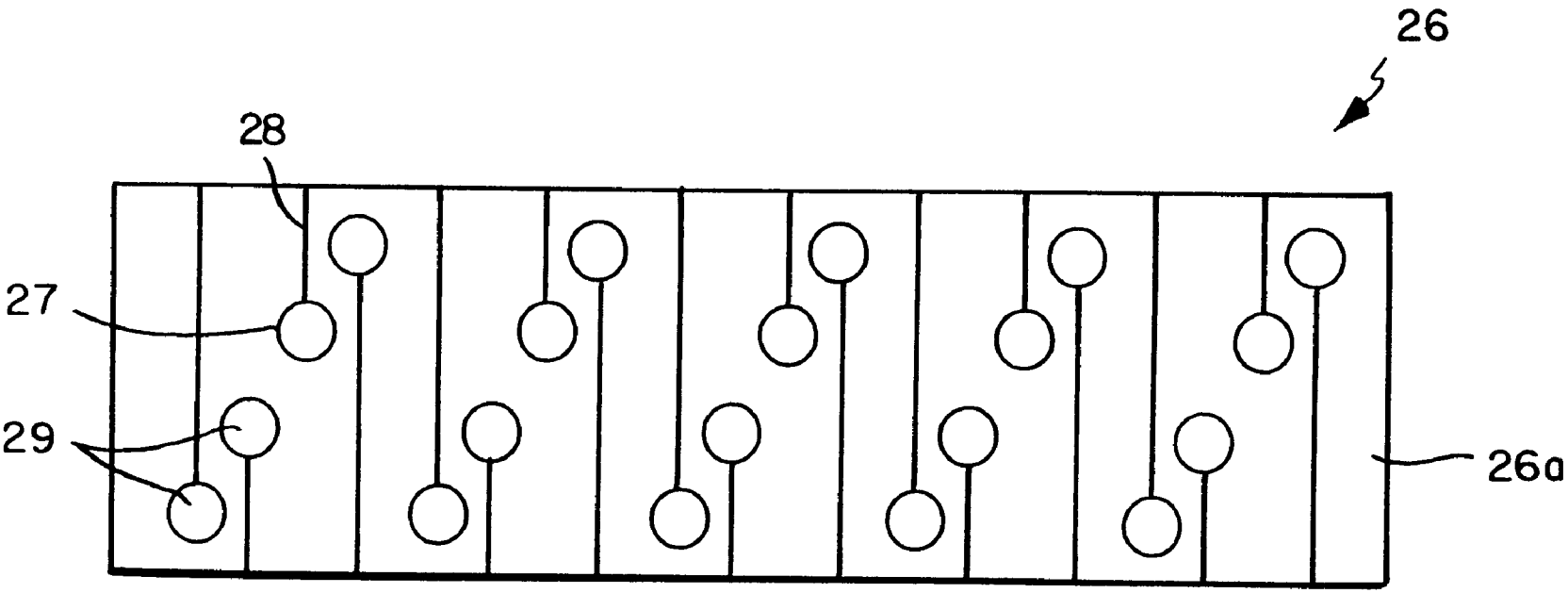
FIG. 3 is a plan view showing a detailed partial structure of the control electrode provided in the image forming apparatus of the invention.
Figure 8:
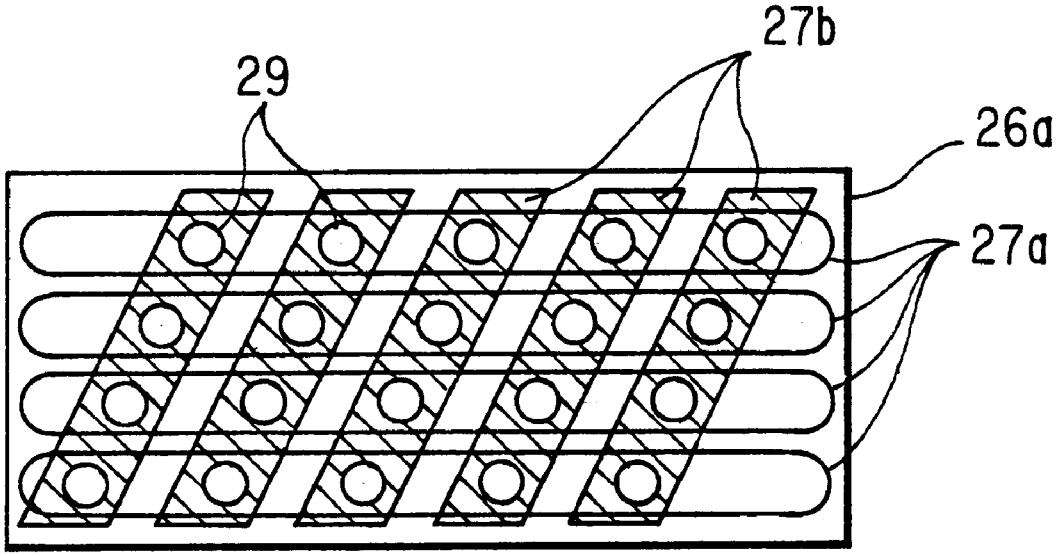
FIG. 8 is a plan view showing another embodiment of a control electrode of the invention, wherein the control electrode has a matrix structure.

In the above description of the embodiment, a single drive control electrode as shown in FIG. 3 was explained as control electrode 26. It is also possible to use a control electrode in a matrix drive form as shown in FIG. 8. Since the matrix drive type can markedly reduce the number of drives required, this feature contributes to reduction in cost.

As shown in FIG. 8, a control electrodes 26 has strip-like electrode groups 27*a* and 27*b* on the front and rear surfaces of a board 26*a*, crossing over each other at right angles. Gates 29 for allowing the toner flow to pass therethrough are formed at the positions where front-side strip-like electrodes 27*a* are across backside strip-like electrodes 27*b*.

As an example, the toner jump voltage in accordance with the image signal is applied to front-side strip-like electrode group 27*a*, while the toner jump voltage in accordance with the scan signal which periodically changes is applied to rear-side strip-like electrode group 27*b*. When the toner jump voltage is applied simultaneously to front and rear side sprit-like electrode groups 27*a* and 27*b*, gates 27 where the front and rear side electrodes cross over each other, cause toner 21 on toner support 22 to jump, and thus the toner travels past the selected gates 29 toward opposing electrode 25.

In this control electrode 26 thus configured, when the electrode group which is on the side facing opposing electrode 25 is controlled in the same manner as above (i.e., for example, 150 V is applied to the electrode for 180 μsec to cause toner 21 to jump), the same effect as described before can be obtained. That is, at the moment the toner passes past rear side strip-like electrode group 27*b*, the voltage applied to electrode group 27*b* is preferably set into the mode which does not permit the toner to jump. Specifically, the time T during.which the voltage continues to be applied to the rear side strip-like electrode group 27*b*, is set to suffice the relation: $t0<T<t$, where t is the time during which toner travels from toner support 22 to opposing electrode 25 side, and t0 is the time at which the toner passes through the rear strip-like electrode group 27*b* of control electrode 26.

When the above voltage application time is controlled based on the period of time T0 shown in the timing chart of FIG. 7, it is possible to have the same effect as before. In this case, the device only needs a driver circuit for application of voltages to electrode groups 27*a* and 27*b* because the device is operated matrix-wise as stated above. This circuit is given in a very simple form, thus making it possible to reduce the cost.

In this embodiment, the description was made of the example where the toner is used as the developer particles, but ink or other substances can be used as the developer particles. In one form of this embodiment, the configuration in which control electrode 26 has annular electrodes 27 as shown in FIG. 3, was described as an example, but the structure of control electrode 26 is not particularly limited. For example, instead of using annular electrodes 27, it is possible to control the jumping of toner 21 from toner support 22 to opposing electrode 25 by providing a plurality of strip-like electrodes matrix-wise on both sides of board 26*a* of control electrode 26 as illustrated with FIG. 8, and controlling the voltages applied to strip-like electrodes which cross over one another at right angles.

Further, it is also possible to construct toner supplying section 2 with a structure using an ion flow process. Specifically, image forming unit 1 may includes an ion source such a corona charger or the like. Also in this case, it is possible to have the same effect as stated above.

The image forming apparatus in accordance with the invention can be preferably applied to the printing unit in digital copiers, facsimile machines as well as to digital printers, plotters, etc.

As has been described heretofore, in the image forming apparatus, the time during which the voltage for causing the developer particles, e.g., toner to pass through is imparted to the control electrode, is set shorter than the time required for the travel of the toner. This feature enables the process speed to increase as well as the resolution to be enhanced without modifying the property of the toner or without enhancing the electric field to be given to the toner.

Since the time during which the voltage for causing the developer particles to pass through is imparted to the control electrode, is set longer than the minimum time required for the developer particles to jump, no jumping failure of the toner occurs, thus no image degradation inclusive of density lowering of the image accompanied by the jumping failure occurs.

As stated above, since the time during which the voltage for causing the developer particles to pass through is imparted to the control electrode, is set longer than the minimum time required for the travel of the developer particles, and shorter than the time required for the developer particles to travel of the toner, this feature enables the process speed to be increased. Also, as the resolution is enhanced without modifying the property of the toner or without enhancing the electric field to be given to the toner. Finally, no image degradation due to density lowering of the image occurs because of no jumping failure of the toner occurring.

In this invention, when a matrix type control electrode is used to control the jumping state of the developer particles matrix-wise, the circuit for applying voltages to the control electrode can be simplified, thus making it possible to reduce the cost.

What is claimed is:

1. An image forming apparatus comprising:

a supporting means for supporting developer particles;

an opposing electrode disposed facing the supporting means;

a control electrode disposed between the supporting means and the opposing electrode and having a plurality of gates which form passages for the developer particles; and a controlling means which generates a predetermined potential difference between the supporting means and the opposing electrode and controls passage of the gates for the developer particles forming an image, wherein the controlling means is configured so that a time, during which a voltage for causing the developer particles to jump to the opposing electrode side is imparted to the control electrode, is set shorter than the time required for the developer particles to travel from the supporting means to the opposing electrode, wherein the voltage applied to the control electrode after the toner particles pass the control electrode is changed to a non jump voltage.

2. An image forming apparatus comprising:

a supporting means for supporting developer particles;

an opposing electrode disposed facing the supporting means;

a control electrode disposed between the supporting means and the opposing electrode and having a plurality of gates which form passages for the developer particles; and a controlling means which generates a predetermined potential difference between the supporting means and the opposing electrode and controls passage of the gates for the developer particles forming an image, wherein a time, during which a voltage for causing the developer particles to jump to the opposing electrode side is imparted to the control electrode is set longer than the time required for the developer particles to travel from the supporting means to the control electrode, and shorter than a time required for the developer particles to travel from the supporting means to the opposing electrode, wherein the voltage applied to the control electrode after the toner particles pass the control electrode is changed to a non jump voltage.

* * * * *